US005326296A

United States Patent [19]

De Jesus

[11] Patent Number: 5,326,296

[45] Date of Patent: Jul. 5, 1994

[54] SWIMMERS AID

[76] Inventor: Juan J. De Jesus, Calle 5 No. G-1, Estancias de San Fernando Carolina, P.R. 00985

[21] Appl. No.: 26,000

[22] Filed: Mar. 4, 1993

[51] Int. Cl.[5] ..... A63B 31/12

[52] U.S. Cl. ..... 441/60; 441/61

[58] Field of Search ..... 441/55-64

[56] References Cited

U.S. PATENT DOCUMENTS

| | | | |
|---|---|---|---|
| 1,843,582 | 2/1932 | Schmitt . | |
| 1,909,259 | 5/1933 | Feir . | |
| 2,729,832 | 1/1956 | Schmitz . | |
| 3,078,482 | 2/1963 | Crowder . | |
| 3,109,186 | 11/1963 | Glenn | 441/60 |
| 3,428,980 | 2/1969 | Newton | 441/55 |
| 4,944,703 | 7/1990 | Mosier . | |
| 5,087,217 | 2/1992 | Tuan et al. . | |

FOREIGN PATENT DOCUMENTS

| | | | |
|---|---|---|---|
| 1089620 | 3/1955 | France | 441/60 |
| 0620973 | 5/1961 | Italy | 441/55 |

*Primary Examiner*—Sherman Basinger

*Attorney, Agent, or Firm*—Oblon, Spivak, McClelland, Maier & Neustadt

[57] ABSTRACT

A swimmer's aid including a strip to which a plurality of laterally extending finlets are attached with the strip being attachable to one or more portions of a swimmer's leg e.g. his shank or his foot, or both. The fins flex in directions opposite to the kick of a swimmer's legs in a manner similar to a conventional foot fin but their center of effort is located closer to the stronger parts of a swimmer's legs rather than only at their extremities as with conventional foot fins. The invention includes a short downwardly angled foot fin having a permanent but shallow angle of about 15° relative to the plane of the foot to permit walking on dry ground while requiring less effort to use in the water.

14 Claims, 10 Drawing Sheets

FIG. 14
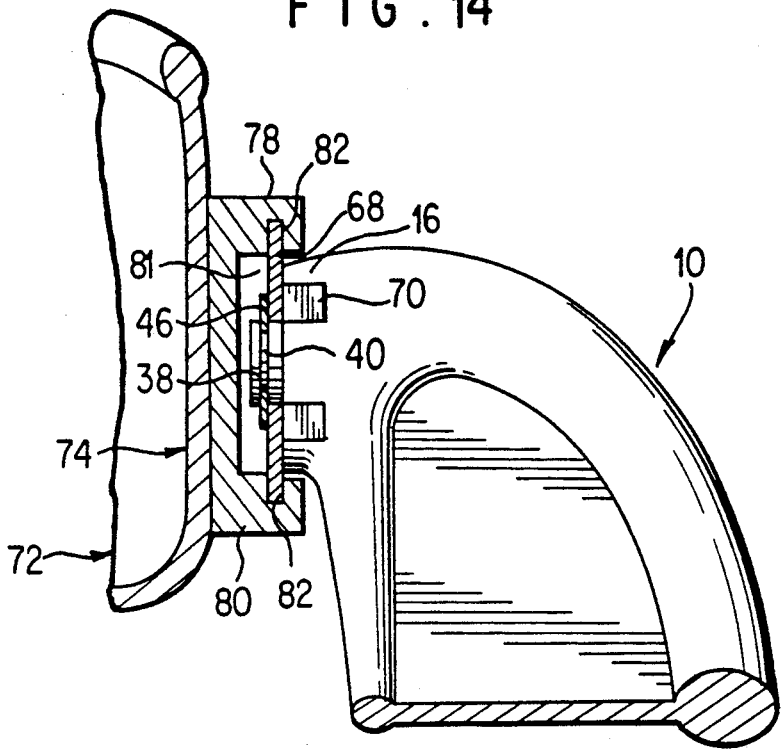
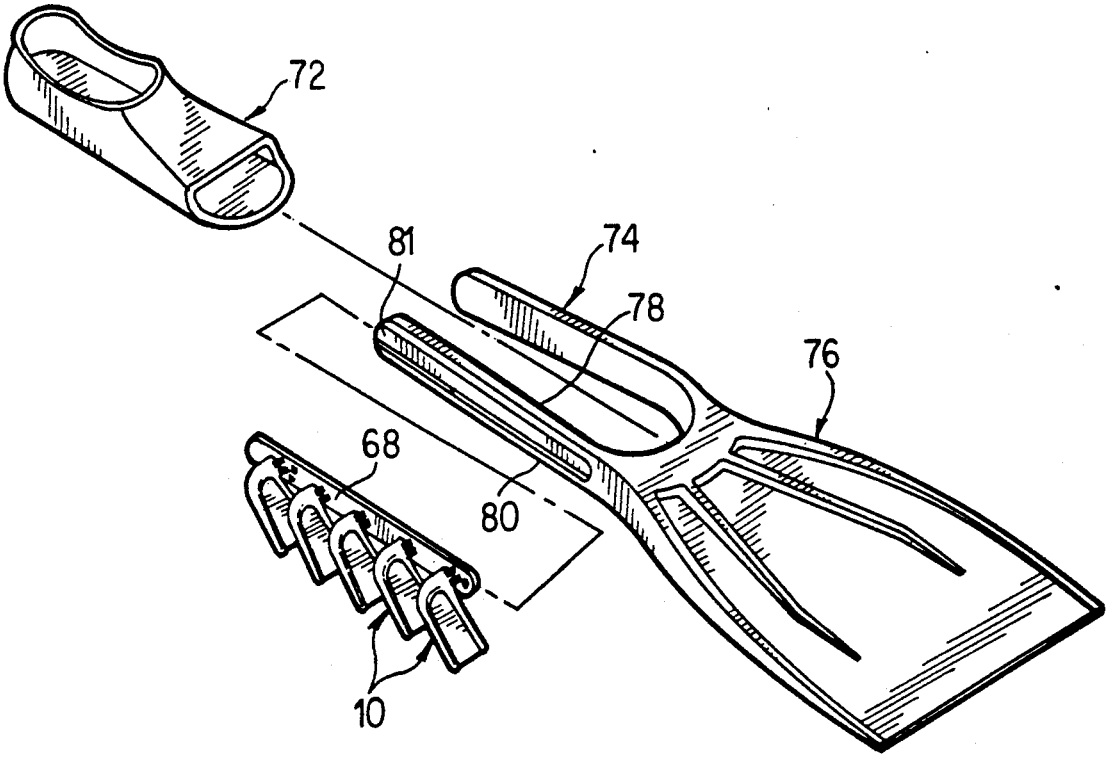
FIG. 15

SWIMMERS AID

FIELD OF THE INVENTION

This invention relates to swimmers aids and more particularly to a swimmers aid for attachment to portions of a swimmers legs to achieve improved utilization of leg muscles for propulsion of a swimmer through water.

BACKGROUND OF THE INVENTION

Fins for attachment to a swimmer's feet are well known. Usually the foot fins are aligned with the swimmer's feet, that is, at right angles to his legs, to facilitate walking on dry ground but when worn in the water the feet must be stretched to a position approximately parallel to the legs and thereafter the legs are kicked up and down in the water, with the swimmer's body being in a substantially prone position. Retaining the feet unnaturally stretched while kicking against the resisting inertia of the water at the extremities of the legs can be extremely tiring. This problem has been recognized and a solution has been suggested in the patent to Crowder No. 3,078,482 wherein propulsion units are disposed along the legs rather than only at their extremities thus making use of leg strength where it is greatest. In that patent a symmetrical flexible hydrofoil, similar in cross-section to a double-camber airplane wing, is supported between two flat, parallel rigid plates spaced apart laterally and interconnected by metallic rod-like members which pass through each hydrofoil adjacent its front and rear edges. As the swimmer kicks his legs, the hydrofoil flexes between the rod-like members with one side of the hydrofoil being concave and the other convex depending on the direction of kick. During a kick, the hydrofoil and both plates partially rotate in unison against the restoring force of a torsion spring coaxial with the forward rod-like member and though it is said the camber of the foil aids forward propulsion it is obvious that as a leg approaches the limit of movement of a kick, the then concave side of the foil acts as a scoop resisting completion of a kick and also resisting forward movement of the swimmer. In addition the plates, rods, and spring create turbulence and could be dangerous to another nearby swimmer. The Crowder unit required the rigid frame defined by the end plates and through-members in order to resist any tendency of the foils to simply fold back about their inner ends to positions substantially parallel to the swimmer's legs where they would be substantially useless for any purpose.

SUMMARY OF THE PRESENT INVENTION

The present invention recognizes that the conventional foot fins are reasonably efficient, albeit tiring, propellers. When a swimmer's foot kicks up, the fin flexes downwardly to an angle which reacts against the water to push the fin and hence the swimmer forwardly. When the foot kicks down the reverse takes place and the swimmer receives another push forwardly. The conventional fin can never flex into a scoop-like configuration which could oppose forward movement of the swimmer.

In common with Crowder, the present invention recognizes the desirability of utilizing the strongest parts of the legs for use in conjunction with a swimmers aid, but instead of relying on rigid rotatable frames projecting at right angles to the legs as in the Crowder device, the invention relies on a plurality of flexible finlets which, in repose on a swimmer's legs project laterally from the legs and extend freely in the direction of the swimmer's feet parallel to but spaced from the legs. Desirably the finlets project laterally on both sides of the swimmer's shanks though they might also project from the thighs, at least outwardly to avoid possible interference were they also to project inwardly. When the swimmer kicks his legs, the finlets flex in a direction opposite to the direction of the kick and thus propel the swimmer forwardly with an action similar to conventional foot fins.

Another aspect of the invention calls for a sandal-like member carrying a forwardly projecting foot fin which extends angularly downwardly with respect to the plane of the sole of the sandal-like member. The angle is relatively flat, on the order of 15°, to permit walking on dry ground yet the angle permits the swimmer to use the foot fin to its best advantage without having to unnaturally and tiringly bend the feet to an extended position which is as close as possible to being in alignment with the leg shank. This feature is, per se, known (see the patent to Schmitz No. 2,729,832) but the fin angle of known fins has been much larger (25° to 50°) making it almost impossible to walk on dry land wearing the fin. In addition to the angled fin, the invention can selectively supply on one or both sides of the sandal-like member a plurality of removable forwardly and downwardly angled flexible finlets similar to those briefly described above for attachment to the swimmer's shanks. As the feet kickup and down the foot finlets flex in opposite directions and in so doing, aid in pushing the swimmer in his direction of travel.

Thus the broad object of the invention is to provide leg and foot finlets as generally described above.

Another object of the invention is to provide improved mounting means for each finlet which allows them to flex only in the desired direction while restraining them from flexing in any other direction with respect to a leg portion, e.g., foot or shank to which the finlets are, during use, attached.

Other objects and their attendant advantages will become apparent as the following detailed description is read in conjunction with the accompanying drawings wherein:

BRIEF DESCRIPTION OF THE DRAWINGS

FIG. 14 is an enlarged broken, cross-sectional view taken substantially on line 14—14 of FIG. 13;

FIG. 15 is an exploded perspective view of the structure of FIGS. 12 and 13.

DETAILED DESCRIPTION OF THE INVENTION

Figure 1:
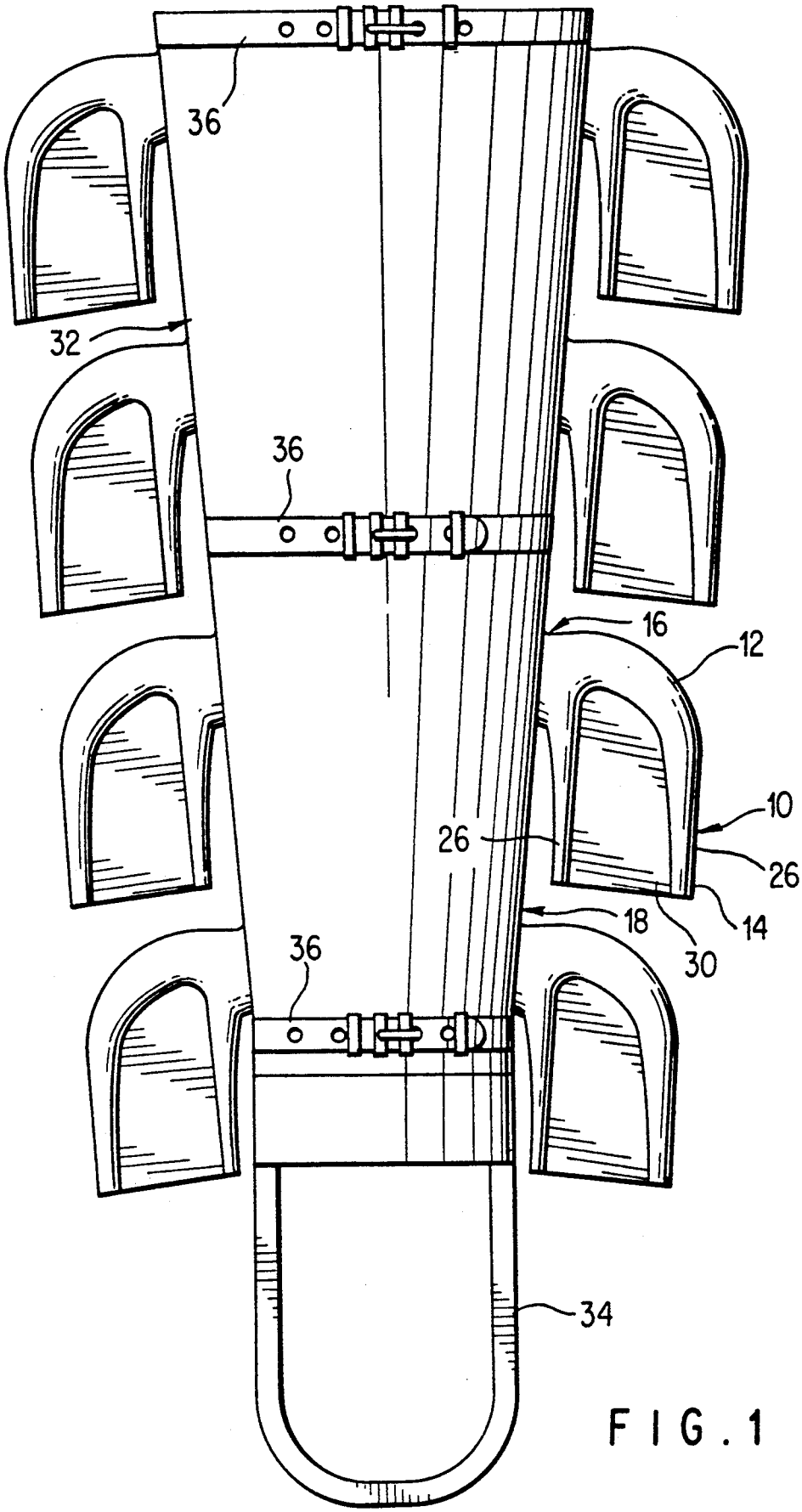
FIG. 1 is a vertical front elevational view of one embodiment of the invention.
Figure 2:
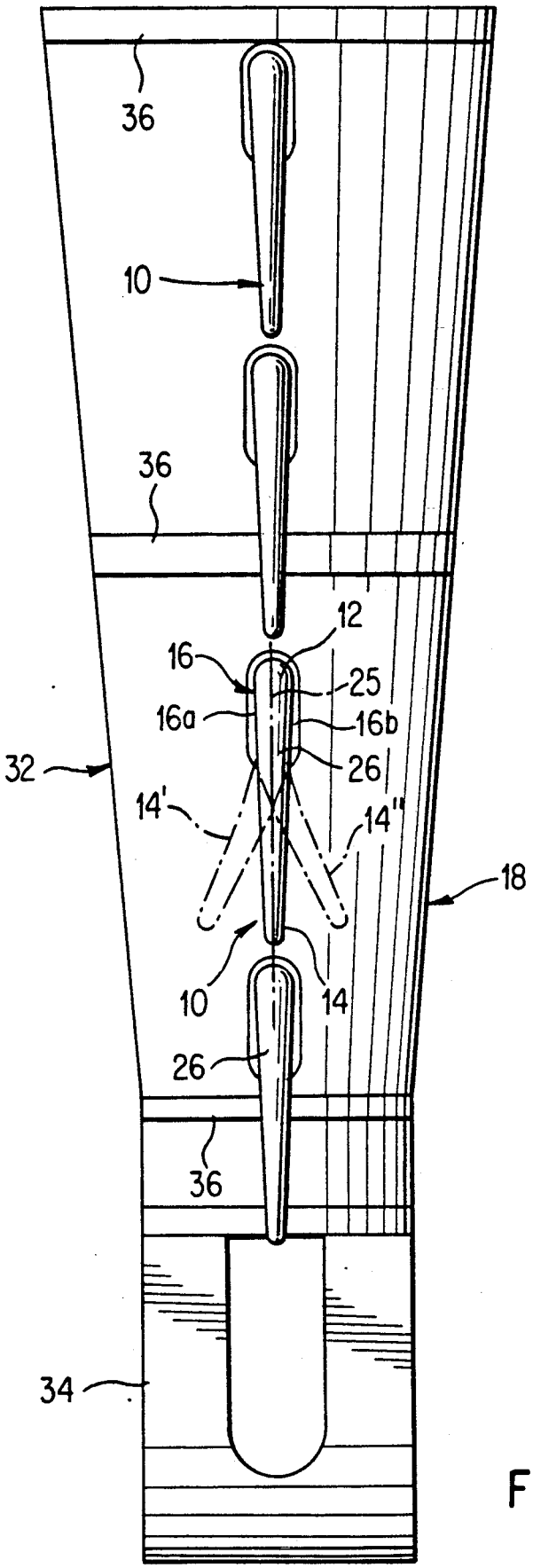
FIG. 2 is a vertical side elevational view of the embodiment of FIG. 1.
Figure 16:
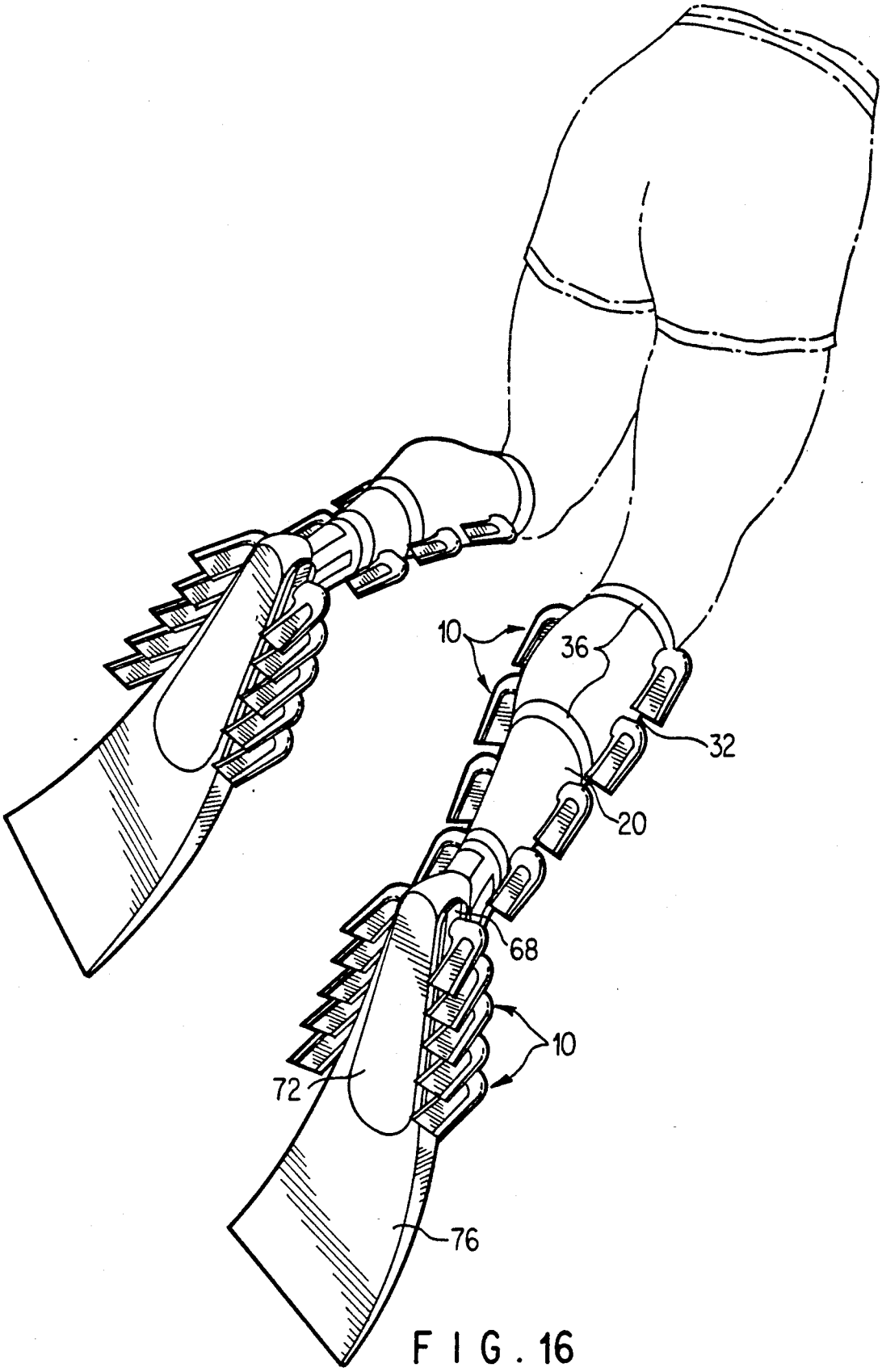
FIG. 16 is a perspective view of the invention as applied to a swimmer's legs.

Referring now to the drawings and particularly FIGS. 1 and 2, the swimmer's aid according to the invention comprises a substantially planar finlet 10 having upper and lower end parts 12, 14 and a laterally extending base 16 integral with the upper end part of the finlet and, as seen in FIG. 2, the base 16 has first and second sides 16*a*, 16*b*. Leg attachment means 18, described in detail below, are provided for releasably attaching the base 16 of a finlet 10 to a portion of a swimmer's leg, such as to the leg shank 20 as seen in FIG. 16, with the lower end part 14 of the finlet extending from the base 16 freely downwardly and laterally spaced away from that portion of a swimmer's leg, e.g. shank, foot, and possibly thigh, to which the finlet is attached.

Though the structure of the finlets can vary, in accordance with the invention they must be capable of flexing about the base portions 16 to either side 14', 14" of their mid planes 25, (FIG. 2) and beyond the sides 16*a*, 16*b* of the base 16 as the leg portion to which the finlets are attached are kicked-up and down in the water. The finlets desirably are of flexible molded rubber or similar material having a thickened perimeter 26 partially encompassing a relatively thin central membrane 30.

A variety of means for attaching a finlet to a portion of a leg of a swimmer may be resorted to. It is within the purview of the invention to strap individual pairs of finlets to the legs at spaced position though desirably and also in accordance with the invention, the bases of a plurality of finlets are first fixed by various means to be described to the outer face of substantially rigid elongated strips.

For use on the shank of a swimmer's leg, the strip may be sandwiched between layers of strong somewhat flexible sheet material which may be similar in shape to the tubular leg sleeves of a wet suit and into which the leg is inserted. With reference to FIGS. 1 and 2 a tubular leg sleeve 32 is there shown having a foot strap 34. Because the finlets 10 are carried on stiff strips whereas the tubular leg sleeves 32 are somewhat flexible, a plurality of vertically spaced straps 36 may encompass the leg shank to comfortably locate a plurality of finlets in their position of use on the swimmer's leg. Instead of a tubular leg sleeve the sleeve with the same described material or harder flexible sheet material on an outside layer, could be slit from top to bottom and either straps 36 provided as shown or lace holes (not shown) could be provided on either side of the slit to receive laces similar to high-top walking boots.

Figure 5:
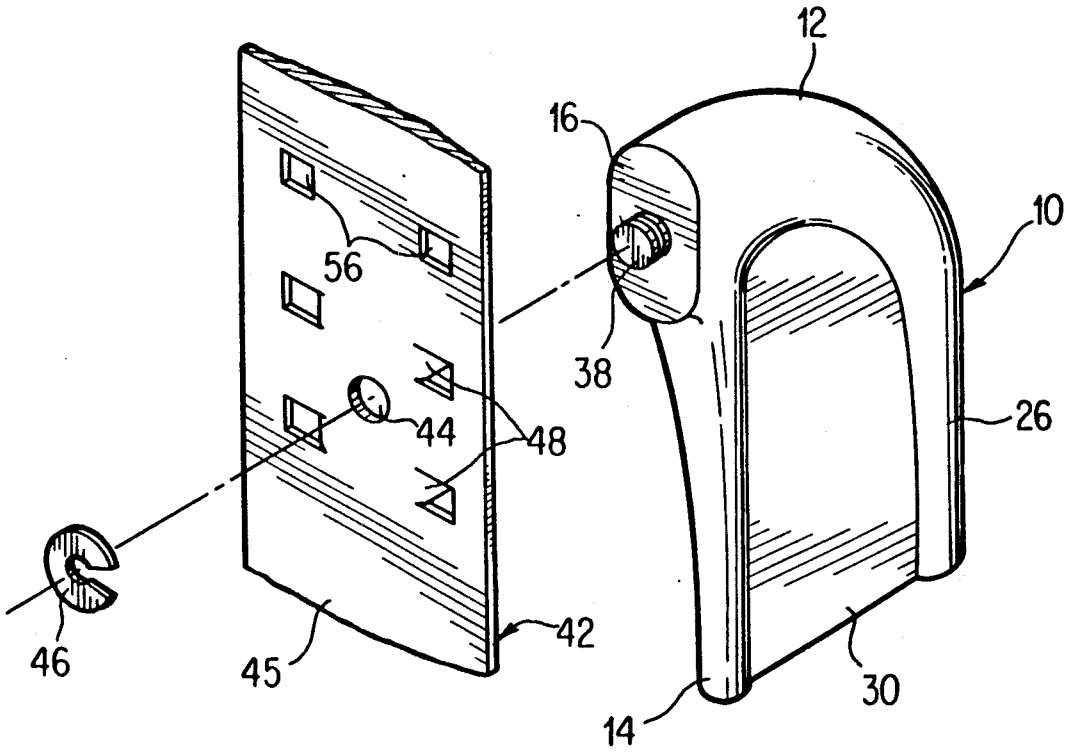
FIG. 5 is an enlarged exploded perspective view of the mounting means of FIGS. 4 and 5.
Figure 7:
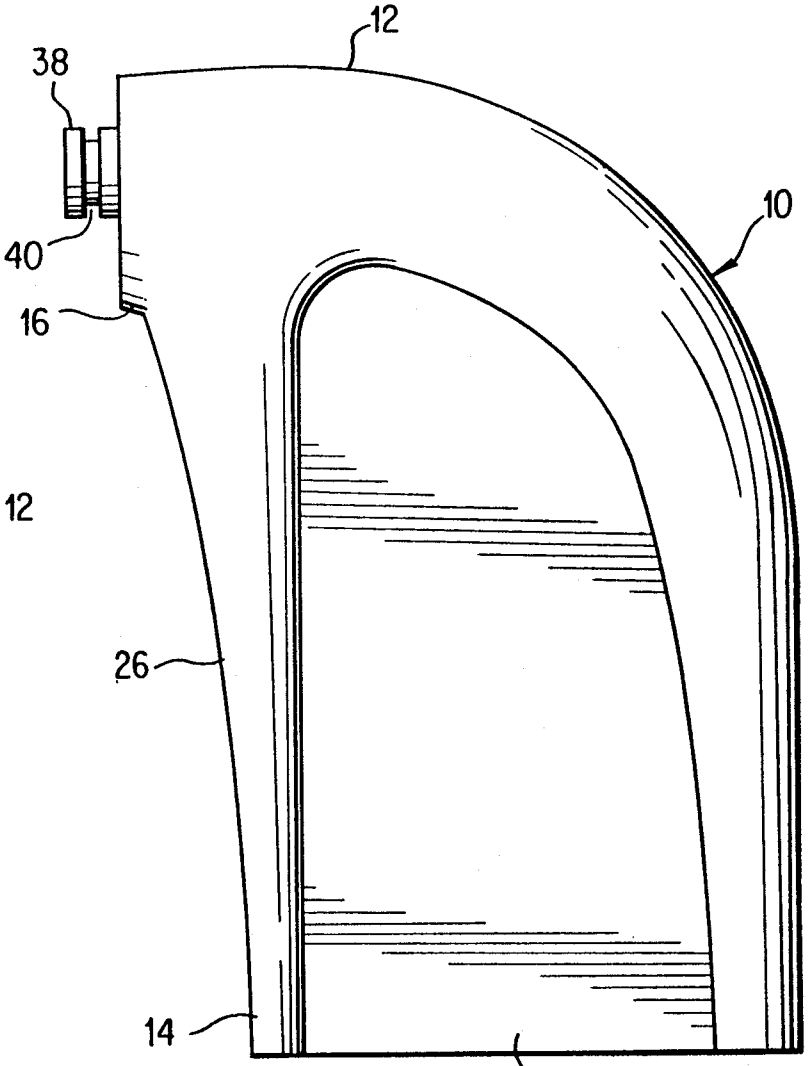
FIG. 7 is a front elevational view of a finlet molded for use with the mounting means of FIGS. 3 through 6.

With reference now to FIGS. 3 through 7, each finlet base 16 may have integrally molded therewith or molded thereto a projection 38 having an annular groove 40 (FIG. 7). The projection 38 is of a size to pass from the front face 41 of a relatively stiff vertical strip 42 through one of a plurality of vertically spaced apertures 44 in the strip and past the rear face 45 of the strip 42 to receive in the groove 40 a split washer 46 as best seen in FIG. 5. Instead of the groove and split washer, the projection could be threaded to receive a nut to clamp the strip between it and the finlet base in the same manner as the split washer.

Figure 3:
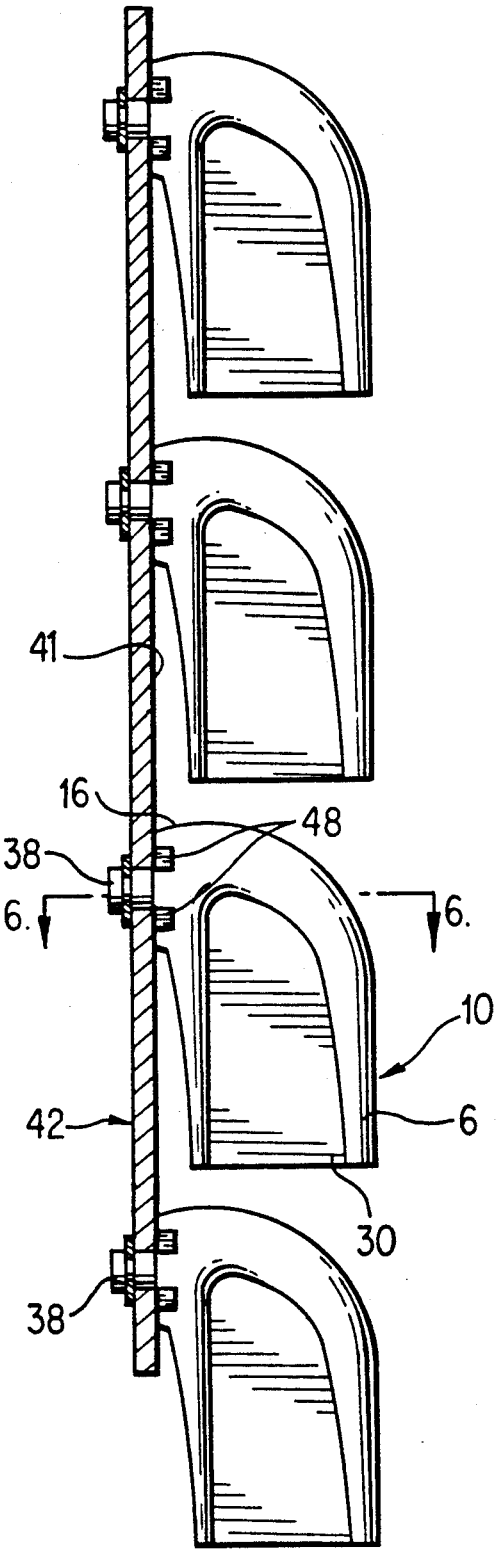
FIG. 3 is a vertical cross sectional view similar to FIG. 1 showing one means for mounting finlets in their position of use.
Figure 4:
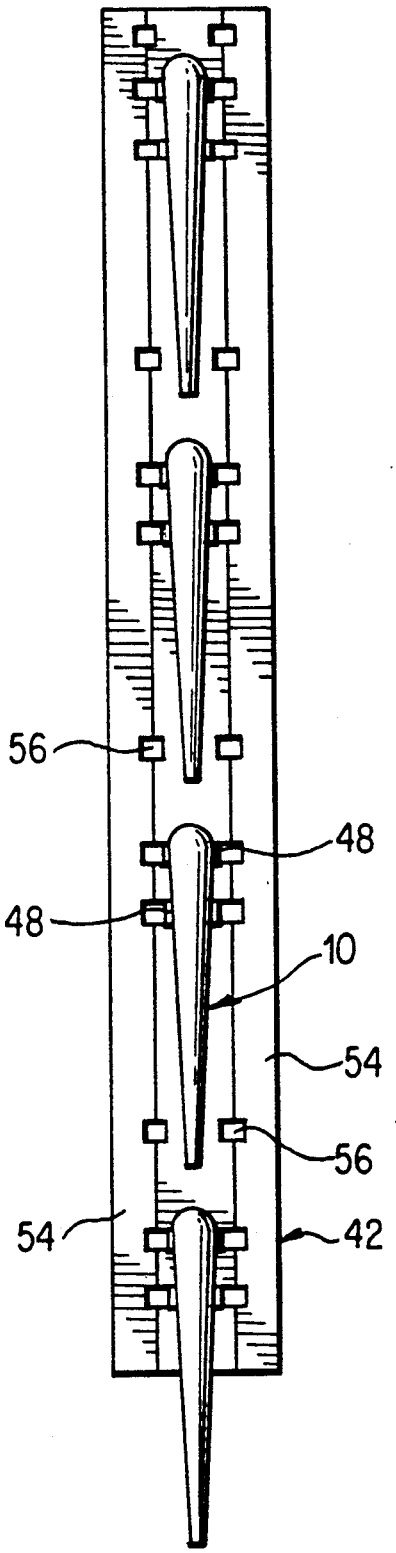
FIG. 4 is a view similar to FIG. 2 but showing in side elevation the mounting means of FIG. 3.
Figure 6:
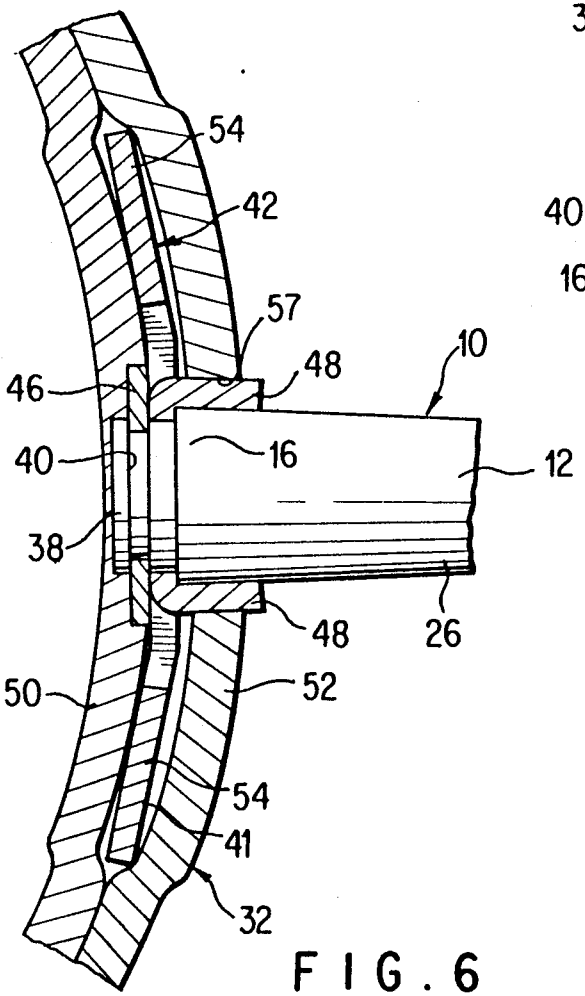
FIG. 6 is an enlarged, broken horizontal cross-sectional view of the mounting means taken substantially on the line 6—6 of FIG. 3.

The strip 42 has laterally extending strike outs 48 located around each aperture 44 in positions to closely embrace the base 16 of each finlet as best seen in FIGS. 3 and 6 to not only prevent rotation of each entire finlet about the lateral axis of its base but also to resist any tendency of the bases 16 to bend or twist forwardly or backwardly, which is to say, inwardly or outwardly of the paper as seen in FIG. 3, relative to the axis of the wearer's leg.

Prior to sandwiching the strip 42 between inner and outer sheets 50, 52 (FIG. 6) defining the shank encircling member 32, the longitudinal sides 54 of the strips 42 may be bent to a shallow angle conforming generally to the external shape of the wearer's shank. The strip 42 which may be plastic or stainless steel and may be immovably encased between the sheets 50, 52, as by acrylic cement, vulcanization, plastic rivets or any other suitable means. If desired, spaced apertures 56 (FIGS. 4 and 5) may be pierced through the strip to receive fastening elements (not shown) or into which the material of the layers 50, 52 may flow if the strip is adhered to the layers by vulcanization. The bases 16 of the respective finlets extend laterally outwardly through suitable openings 57 in the outer sheet 52 (FIG. 6).

Figure 9:
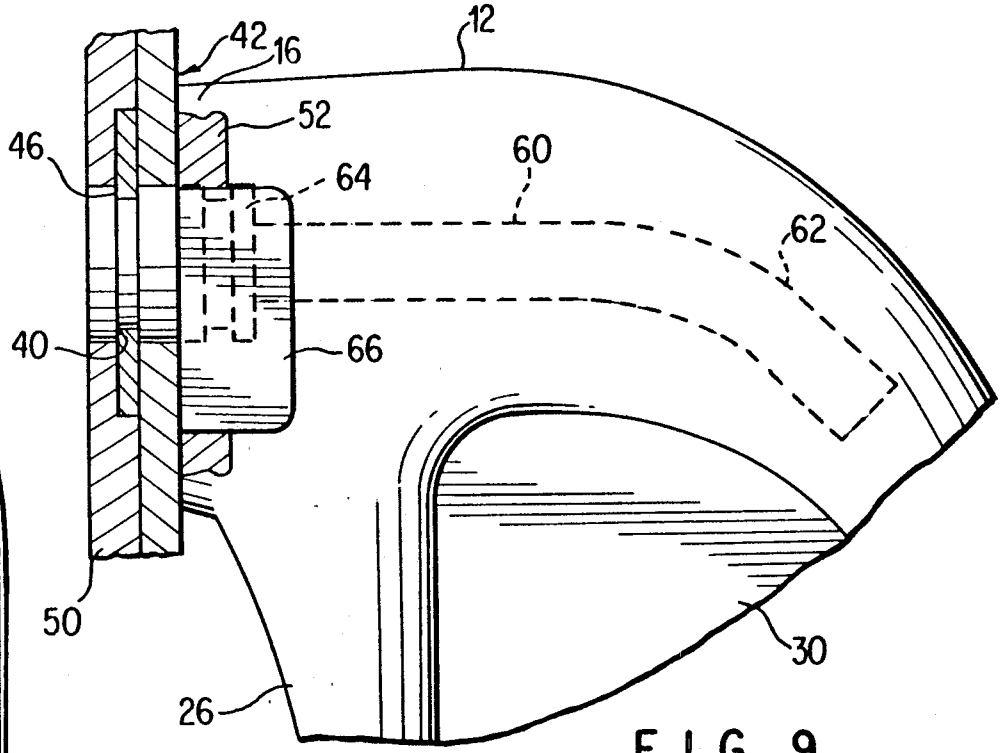
FIG. 9 is an enlarged broken front view, partly in elevation and partly in vertical cross section, showing the modification of FIG. 8 mounted in its position of use.
Figure 8:
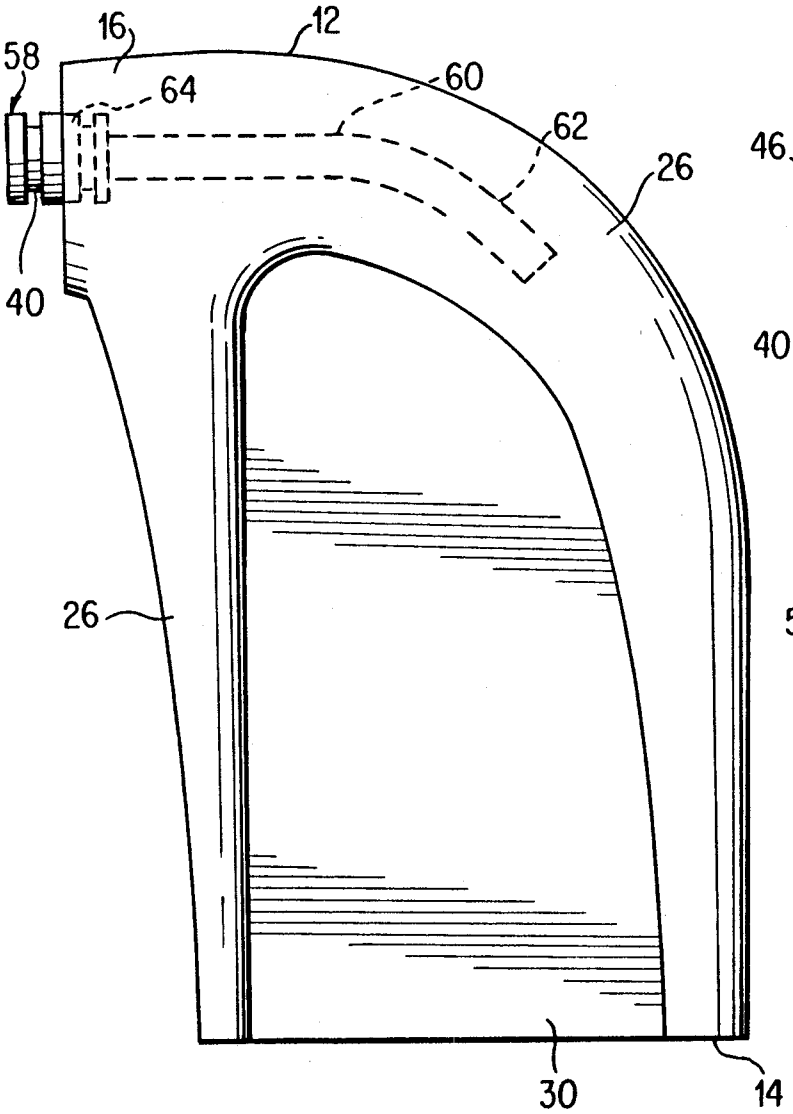
FIG. 8 is a front elevational view of a modification of the finlet of FIG. 7.

The projection 38 for each finlet may, as suggested, be integrally molded with the finlet but, alternatively, it may be a strong premolded plastic or metal member about which the finlet base is molded. If the projection 38 is a separate component such as the member 58 as shown in FIGS. 8 and 9 (where like parts receive like reference characters of FIGS. 1 through 7) it may be provided with an integral rigid, laterally extending rod-like element 60 which is molded into the upper end of the thickened perimeter 26 of the finlet. The element 60 may have a down turned outer end 62 and its inner end can be integral with an embedded outer end 64 of projection 58, the end 64 being conveniently a mirror image of projection 58. The rod 60 positively prevents the finlet base from moving either front to back or up and down relative to the leg of the swimmer. By making the rods 60 of material having some resilience, bruising of a near-by swimmer would be minimized should a finlet strike that swimmer while the wearer is kicking his legs. Finally, to prevent any possibility of a finlet base rotating about the lateral axis of the base, strike outs 66 (FIG. 9) similar to strikeouts 48 seen in FIGS. 5 and 6, may be provided to embrace the base 16 of the finlet.

Figure 10:
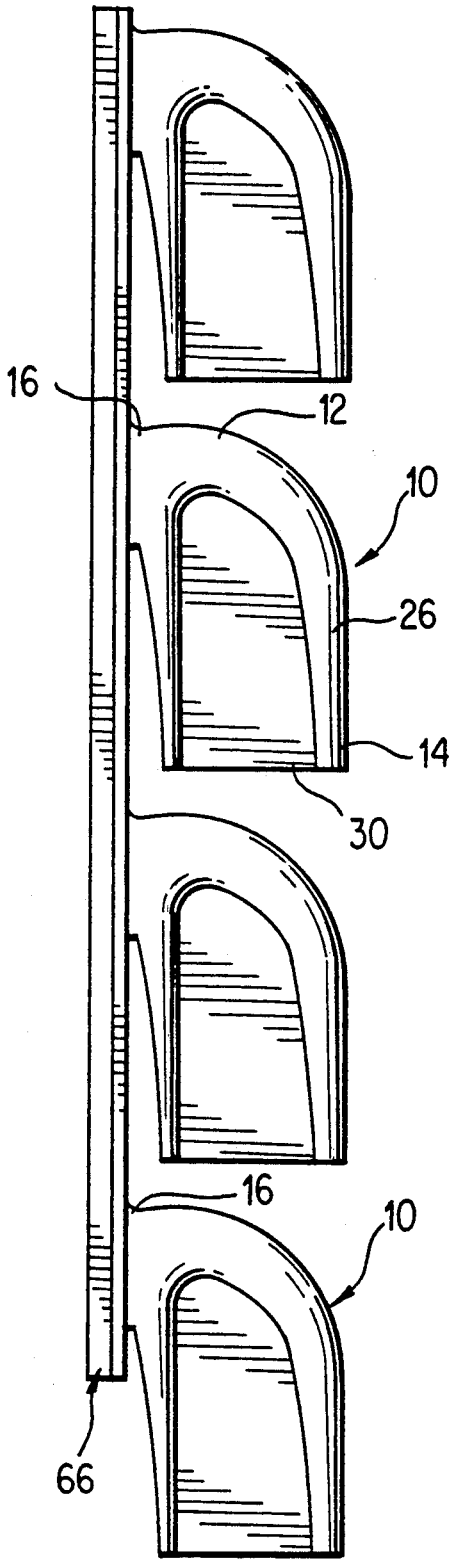
FIGS. 10 and 11 are front and side elevational views of yet another modification of the invention.
Figure 11:
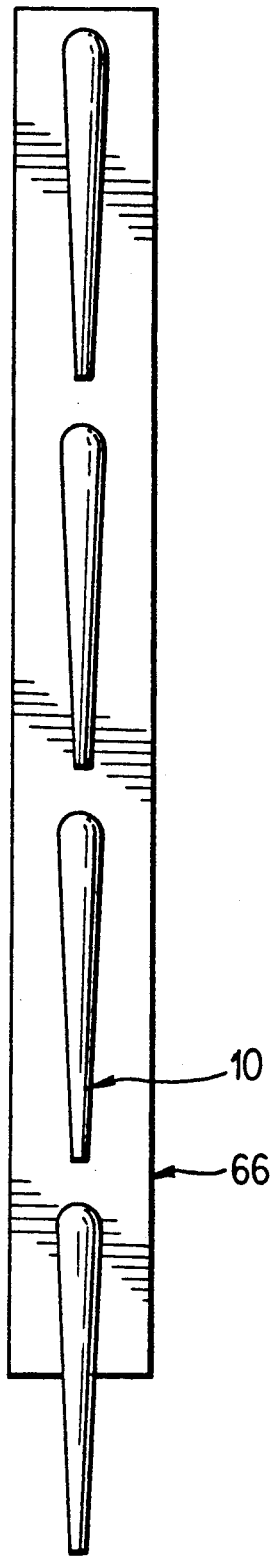
Figure 12:
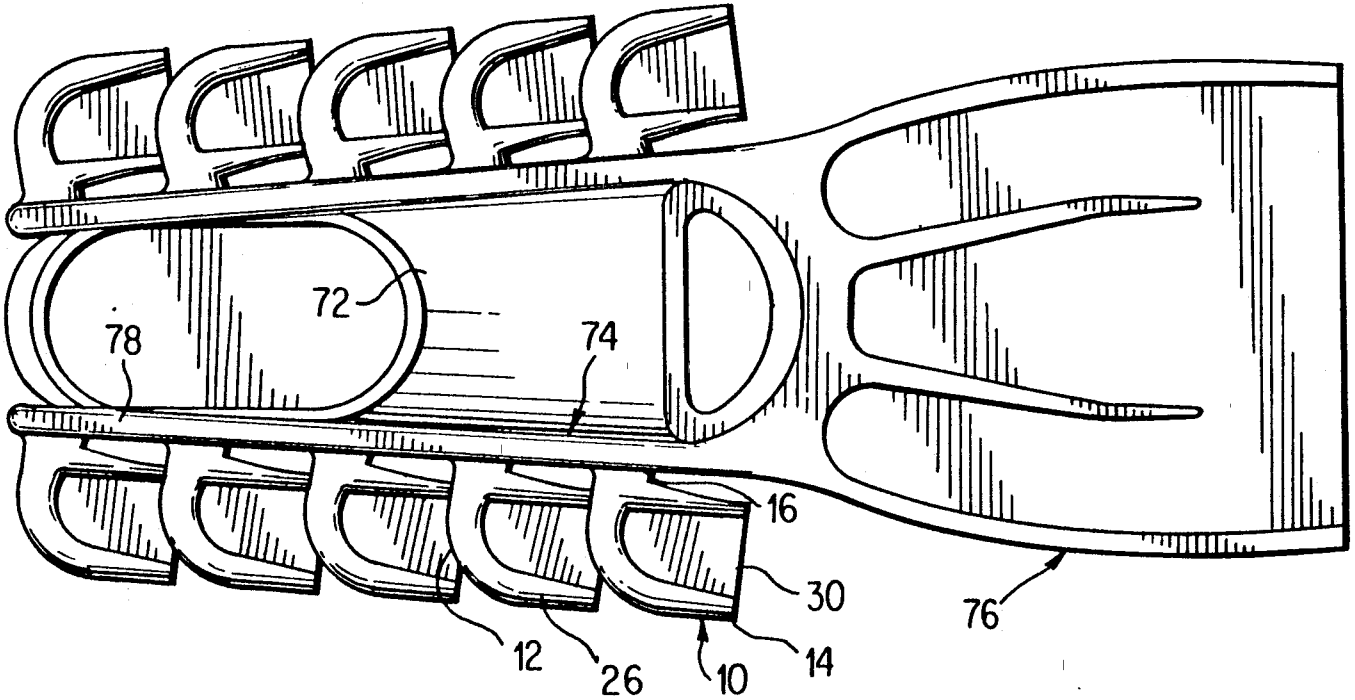
FIG. 12 is a top plan view of an assembly of a sandal-like member carrying a main foot fin and a plurality of side finlets all constructed in accordance with the invention.

Instead of the finlets being separately attached to the strip as described above, the finlets and strips may be molded together as shown in FIGS. 10 and 11 where again, like reference characters refer to like parts. As shown, the base 16 of each finlet 10 is molded as a unit with a strip 66 which may be secured to the leg encircling member as described above. The unit of FIGS. 10 and 11 has particular utility for snorkeling but has a disadvantage in that should a finlet break away from the strip, the entire strip and remaining finlets and possibly the leg encircling member may have to be discarded. With separately mounted finlets, small holes on the inner sheet 50 of the leg encircling member may be left around a projection 38 to permit removal of the snap washer 46 and subsequent replacement of the damaged finlet by a new one.

Figure 13:
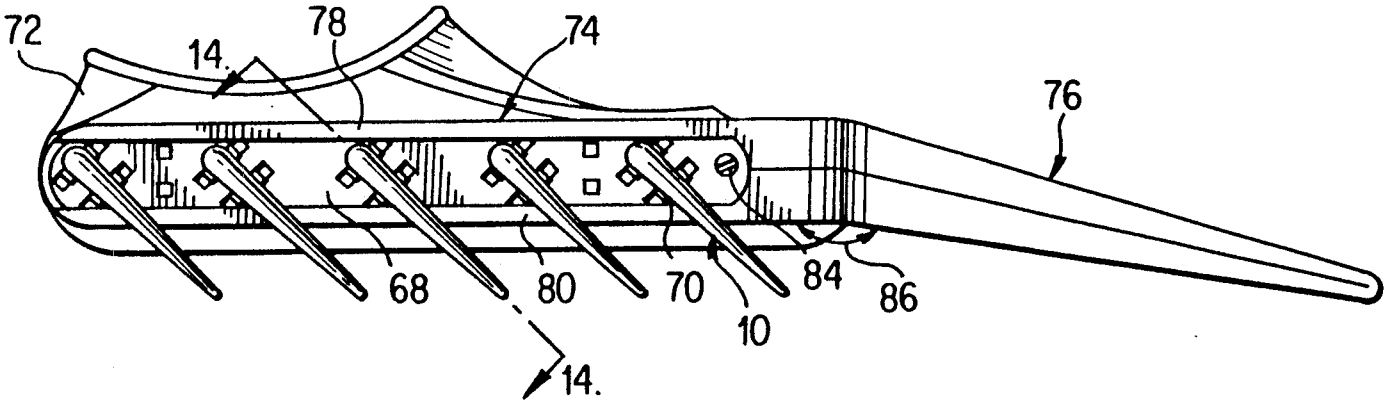
FIG. 13 is a side elevational view of the member of FIG. 12.

Referring now to FIGS. 12 through 16, shown there are finlets 10 whose structure, while being smaller is otherwise identical to that described above, and, again, like reference characters apply to like parts. As above, each finlet 10 is fixed to a strip 68 in the same way as the finlets 10 are fixed to the strip 42 as seen in FIGS. 5 and 6, which is to say and with reference to Fig- 14, the base 16 of each finlet carries a projection 38 having an annular slot 40 for receiving a split washer 46 after the projection has been inserted through an aperture in the strip 68. Each aperture is flanked by two pairs of strike outs 70 which are oriented, as best seen in FIG. 13, to embrace the bases of the finlets to lock the bases against movement relative to the strip and in positions where the finlets extend angularly forwardly and downwardly relative to the longitudinal axis of the strip 68.

In accordance with the invention open-toed sandal-like members 72, best seen in FIG. 15, are provided and to the sides of which are connected rearwardly projecting extensions 74 of a foot fin 76, described in greater detail below. The outer sides of the extensions 74, as best seen in Fig- 14, are provided with upper and lower laterally extending flanges 78, 80 defining a channel 81 whose confronting surfaces are grooved at 82 to slideably receive the upper and lower edges of the strip 68. The channels 81 are open at their rear ends and the strips 68 are readily slid into the grooves 82 after which they are releasably fastened in the channels by suitable releasable fastening means represented by'the screw head 84 best seen in FIG. 13.

Referring now to the foot fin 76 it will be noted in FIG. 13 that the plane of the fin is angled downwardly and forwardly relative to the sole of the sandal 72 and at a relatively shallow angle 86 (FIG. 13) of about 15°. This is a permanent angle and the fin 76 is made relatively short with the shallow angle 86 in order to permit a wearer to walk on dry land through the main purpose of the angled fin 76 is to permit a swimmer wearing the fins in water to position his feet at a more comfortable angle relative to the remainder of the leg than that required where the planes of the foot and fin are co-extensive, requiring that the swimmer bend his feet to the maximum relative to the axis of the leg shank in order to make the most efficient use of the foot fins. With the angled and short foot fin, 76 and angled foot finlets 10 of the invention the swimmer need not bend his feet to the same degree as required by conventional fins yet the fins provide the same degree of propulsion efficiency as conventional fins but with substantially less tiring effort.

Though angled fins for achieving a similar purpose are known (see above) such fins cannot be worn for walking. The invention is based on the discovery that substantially the same good results can be achieved in the water with a shorter fin and a shallow fin angle and a pronounced 45° finlets angle as the more sharply angled fin of the prior art, with the added advantage of permitting the fin to be worn while walking on dry land. Because the use of the angled and shorter foot fin 76 is less tiring, additional power is available for driving the foot-carried finlets described immediately above.

It is believed that use of the shank attached finlets should be apparent from the foregoing description and with reference to FIG. 16. It will be apparent that both the foot and shank attached finlets with the angled and shorter foot fins 76 can be worn simultaneously for maximum propulsion. For some, maximum propulsion power is not necessary and thus the shank finlets can be easily removed so that the swimmer relies only on the foot finlets and the angled foot fin 76. If this combination is also unsuitable, the swimmer merely discards the foot fins and relies exclusively on the shank-carried finlets which provide good and efficient propulsion with least effort since the finlets are being swept through the water with a part of the leg which is substantially stronger than the feet alone and with the center of effort spaced a substantial distance above the feet. It will be apparent that the channels 81 instead of being on parts of the foot fin could be on the sides of the sandal-like member 72 whereby the foot fin could be removed and only the foot finlets employed or simultaneously with the shank finlets.

It will be apparent that the invention is susceptible to a wide variety of changes and modifications without, however, departing from the scope and spirit of the appended claims. Where in the claims a finlet is said to extend downwardly this means downwardly relative to a wearer's leg when in a vertical position, as when the wearer is standing. A "portion of a swimmer's leg" means anyone or a part of any one of the swimmer's thigh, shank or foot.

What is claimed is:

1. A swimmer's aid comprising a flexible substantially planar finlet having upper and lower end parts and a latterly extending base having first and second sides and being integral with the upper end part of said finlet, means for releasably fixing said base to a portion of a swimmer's leg with the upper end part of said finlet extending from said base laterally away from said swimmer's leg portion and said lower end part extending freely downwardly from said upper end part and laterally spaced away from said portion of a swimmer's leg, said power end part of said finlet having a free end having flexibility enabling said free end to flex about said base beyond said first and second sides of said base and to either side of the plane of said finlet in response to up and down kicking motion in water of said leg portion, and means for restraining said finlet from flexing in response to said kicking motion in any other direction with respect to said leg portion.

2. The swimmer's aid according to claim 1 wherein said releasable fixing means includes means for fastening the bases of a plurality of finlets together in spaced relation along at least a part of the length of said portion of said swimmer's leg.

3. The swimmer's aid according to claim 2 wherein said releasable fixing means for a plurality of finlets comprises a substantially rigid, longitudinally extending strip having front and rear faces, means for rigidly connecting said bases to said strip in longitudinally spaced relationship, and means for releasably attaching said strip to a portion of a swimmer's legs.

4. The swimmer's aid according to claim 3 wherein the means for connecting said bases to said strip comprises a plurality of spaced apertures through said strip, laterally extending projections fixed to said bases for passing through said apertures from the front face to extend past the rear face of said strip, and connecting means carried by the extending parts of said projection for clamping said strip between said connecting means and said bases.

5. The swimmer's aid according to claim 4 including a plurality of projections extending laterally outwardly from said strip in the vicinity of each aperture, said projections being positioned to engage said first and second sides of said finlet bases to prevent said bases from rotating about their lateral axes and from flexing relative to said strip.

6. The swimmer's aid according to claim 4 wherein each connecting means comprises an annular groove about that end of said projection extending past the rear face of said strip and a split washer received in said annular groove.

7. The swimmer's aid according to claim 4 wherein each of said projections is a separate element having an outer end molded into said base, and a substantially rigid rod having one end fixed to said outer end of said projection and extending laterally within the upper end of a finlet to resist flexing in any direction of said base and the upper end of said finlet relative to said strip.

8. The swimmer's aid according to claim 3 wherein said strip bases and finlets comprise an integral molding.

9. The swimmer's aid according to claim 3 wherein the means for attaching said strip to a portion of a swimmer's leg comprises a first inner sheet for encompassing a swimmer's leg and a second outer sheet encompassing the first inner sheet, said strip being sandwiched between said sheets with said bases extending laterally outwardly through openings in said outer sheet.

10. The swimmer's aid according to claim 9 including, in addition, at least one adjustable leg encircling strap.

11. The swimmer's aid according to claim 3 wherein the portion of a swimmer's leg is his foot and said means for attaching the strip to the foot comprises a foot receiving sandal-like member having sides to which are fastened vertically spaced elongated flanges defining rearwardly open channels, each including means for slideably receiving said strip with laterally extending finlets attached, and means for releasably fixing said strip within said channel.

12. The swimmer's aid according to claim 11 wherein said flanges are carried on rearwardly extending projections of a forwardly extending foot fin.

13. The swimmer's aid according to claim 12 wherein said foot fin in unflexed condition slopes normally forwardly and downwardly at an angle with respect to the plane of said sandal-like member, the angle of slope of said foot fin being about 15°.

14. The swimmer's aid according to claim 11 including means carried by said strip and engaging the bases of said finlets for orienting said finlets so that the free ends thereof in unflexed condition extend downwardly and forwardly relative to the longitudinal axis of said strip.

* * * * *